US010700478B2

(12) United States Patent
I

(10) Patent No.: US 10,700,478 B2
(45) **Date of Patent: *Jun. 30, 2020**

(54) HEAT DESTRUCTIVE DISCONNECTING SWITCH

(71) Applicant: GREEN IDEA TECH INC., Mahe (SC)

(72) Inventor: Hsiang-Yun I, Tainan (TW)

(73) Assignee: GREEN IDEA TECH INC., Mahe (SC)

( * ) Notice: Subject to any disclaimer, the term of this patent is extended or adjusted under 35 U.S.C. 154(b) by 0 days.

This patent is subject to a terminal disclaimer.

(21) Appl. No.: 16/215,602

(22) Filed: Dec. 10, 2018

(65) Prior Publication Data

US 2020/0014155 A1 Jan. 9, 2020

(30) Foreign Application Priority Data

Jul. 3, 2018 (TW) ..... 107123011 A

(51) Int. Cl.
*H01R 13/713* (2006.01)
*H01H 3/02* (2006.01)
(Continued)

(52) U.S. Cl.
CPC ..... *H01R 13/7137* (2013.01); *H01H 3/022* (2013.01); *H01H 3/12* (2013.01);
(Continued)

(58) Field of Classification Search
CPC .... H01R 13/7137; H01R 25/003; H01H 3/12; H01H 3/022; H01H 2221/044;
(Continued)

(56) References Cited

U.S. PATENT DOCUMENTS 6,400,250 B1 * 6/2002 Wang ..... H01H 73/26 337/66
7,688,174 B2 * 3/2010 Hung ..... H01H 23/025 337/56

(Continued)

FOREIGN PATENT DOCUMENTS

CN 103441019 B 10/2015
TW 321352 11/1997

(Continued)

*Primary Examiner* — Jayprakash N Gandhi
*Assistant Examiner* — Stephen S Sul
(74) *Attorney, Agent, or Firm* — Michael D. Eisenberg

(57) ABSTRACT

A heat destructive disconnecting switch comprises a first conductive member, a second conductive member, a movable conductive member, an overheating destructive member, an operating component, and a second elastic member. The movable conductive member conducts electricity to the first conductive member and the second conductive member. The overheating destructive member is formed as an integral body on a limiting member, and a first elastic member is compressed to between a contact member and the overheating destructive member, thereby providing the first elastic member with a first elastic force. The second elastic member is provided with a second elastic force. When the overheating destructive member is destructed due to overheating, the first elastic force is smaller than the second elastic force, causing the movable conductive member to disconnect the first conductive member from the second conductive member to achieve a protective effect from overheating.

6 Claims, 8 Drawing Sheets

(51) Int. Cl.
*H01H 3/12* (2006.01)
*H01R 25/00* (2006.01)

(52) U.S. Cl.
CPC . *H01H 2221/016* (2013.01); *H01H 2221/044* (2013.01); *H01H 2221/068* (2013.01); *H01H 2239/06* (2013.01); *H01R 25/003* (2013.01)

(58) Field of Classification Search
CPC ..... H01H 2221/016; H01H 2221/068; H01H 2239/06; H01H 39/00; H01H 85/00; H01H 37/32; H01H 37/76–761; H01H 37/764–767; H01H 2037/762–763; H01H 73/26; H01H 85/08
USPC ..... 337/401
See application file for complete search history.

(56) References Cited

U.S. PATENT DOCUMENTS

| | | | | |
|---|---|---|---|---|
| 9,698,542 | B1 | 7/2017 | I | |
| 10,403,459 | B1 * | 9/2019 | I | H01R 13/7137 |
| 2004/0037020 | A1 * | 2/2004 | Yu | H01H 73/26 361/103 |
| 2010/0231347 | A1 * | 9/2010 | Knab | H01H 37/761 337/143 |
| 2016/0006235 | A1 * | 1/2016 | Wang | H02H 3/38 361/91.2 |
| 2017/0047180 | A1 * | 2/2017 | Wang | H01C 7/12 |
| 2017/0148601 | A1 * | 5/2017 | Wang | H01H 89/04 |
| 2017/0148602 | A1 * | 5/2017 | Wang | H01H 37/761 |
| 2019/0019641 | A1 * | 1/2019 | Signer | H05K 1/0201 |

FOREIGN PATENT DOCUMENTS

| | | |
|---|---|---|
| TW | 560690 | 11/2003 |
| TW | 250403 | 11/2004 |
| TW | 382568 | 6/2010 |

* cited by examiner

HEAT DESTRUCTIVE DISCONNECTING SWITCH

CROSS REFERENCES TO RELATED APPLICATIONS

The present application claims priority from Taiwanese Patent Application Serial Number 107123011, filed Jul. 3, 2018, the disclosure of which is hereby incorporated by reference herein in its entirety.

BACKGROUND OF THE INVENTION

(a) Field of the Invention

The present invention relates to a heat destructive disconnecting switch, and more particularly to a power-off structure that is distinct from a fuse and different from a bimetallic strip. An overheating destructive member of the present invention does not depend on the passing of current to enforce destruction thereof, but uses heat energy transfer to bring about destruction and cause the switch to cut off power.

(b) Description of the Prior Art

Seesaw switches of the prior art use a control switch to effect back and forth pivot rotation within a specified angle range to control closing or opening a circuit. For example, the prior art structure of a "Spark shielding structure of switch" disclosed in ROC Patent No. 560690 describes a positioning feature when pivot rotating a switch to position the switch at a first position or a second position to form a closed circuit or an open circuit.

As for press switches of the prior art, pressing the press switch enables cycling through controlling the closing or opening of a circuit, wherein the press button uses the reciprocating press-button structure similar to that used in an automatic ball-point pen of the prior art, whereby the press button is positioned at a lower position or an upper position each time the switch press button is pressed, an example of which is described in the prior art structure of a "Push-button switch" disclosed in China Patent No. CN103441019.

In the prior art structure of an "Improved structure of an on-line switch" described in ROC Patent No. 321352, a switch structure is disclosed that is provided with a fuse; however, the fuse is positioned in the path of the power supply live wire, and thus necessarily depends on electric current passing therethrough in order to bring about a protective effect. In particular, only when the power supply is overloaded will the fuse melt and cut off the supply of power. In as much the fuse requires a current to pass through during operation, however, the current must be excessive in order to melt the fuse, hence, a low-melting-point lead-tin allow or zinc, that have a electric conductivity far lower than that of copper, is often used for the fuse. Taking an extension cord socket as an example, which mainly uses copper as a conductive body, if the extension cord socket is combined with the switch disclosed in the above-described ROC Patent No. 321352 to control the power supply, then conductivity of the fuse is poor, easily resulting in power-wasting problems.

In the prior art structure of a "Bipolar type auto power off safety switch" described in ROC Patent No. M382568, a bimetallic strip type overload protection switch is disclosed; however, the bimetallic strip must similarly be positioned in the path of the electric current, and thus necessarily depends on electric current passing therethrough for deformation of the bimetallic strip to occur. More particularly, an overloaded electric current is necessary in order to cause the bimetallic strip to deform and break the circuit.

In the prior art structure of an "Overload protection switch structure for group type socket" described in ROC Patent No. M250403, an overload protection switch applied in an extension cord socket is disclosed, wherein the patented overload protection switch is fitted with a bimetallic strip. When the total power of the entire extension cord socket exceeds the rated power, the bimetallic strip undergoes heat deformation and automatically trips, thereby achieving a power-off protective effect. However, the bimetallic strip necessarily depends on electric current passing therethrough in order to bring about an overload protective effect. Moreover, electric conductivity of the bimetallic strip is far lower than that of copper, which, thus, easily results in power-wasting problems.

Nevertheless, apart from current overload causing overheating, taking an extension cord socket as an example, the following situations are all possible scenarios resulting in overheating of any one of the sockets, including:

1. Serious oxidation of the metal pins of the plug, wherein the metal pins have become coated with oxides; thus, when the plug is inserted into a socket, the oxides, having poor conductivity, cause greater electrical resistance, which results in the socket overheating.

2. When inserting the metal pins of a plug into a socket, and the metal pins are not completely inserted, resulting in only partial contact, then the contact areas are too small, which causes the socket to overheat.

3. Metal pins of the plug are deformed or worn out, resulting in incomplete contact when inserted into a socket and the contact areas being too small, which gives rise to the socket overheating.

4. Metal pins of the plug or metal strips of the socket are stained with foreign substances, such as dust or dirt, causing poor electric conductivity, which results in greater electrical resistance and overheating.

The above-described conditions result in a critical drop in the operating temperature in the locality of the socket and the operating temperature in the locality of the overload protection switch.

The inventor of the present invention in an "Assembly and method of plural conductive slots sharing an overheating destructive fixing element" described in U.S. Pat. No. 9,698,542 disclosed distance of a copper strip and temperature difference experimentation, and from the test results presented in TABLE 2 of the above patent, it can be seen that if the above-described overheated socket is positioned at test position 10 of TABLE 2, and the above-described overload protection switch is positioned at test position 1 of TABLE 2, with a distance of 9 cm between the two positions, then when the socket operating temperature reaches 202.9° C., after 25 minutes, the operating temperature of the overload protection switch is only 110.7° C.; that is, when the distance between the socket and the overload protection switch is 9 cm, and when the operating temperature of the socket has already overheated to a temperature of 202.9° C. with the possibility of accidental combustion, then the bimetallic strip of the overload protection switch is still only at a temperature of 110.7° C., and has not yet reached deformation temperature; thus, the overload protection switch will not automatically trip a power-off.

Because there are many circumstances resulting in socket overheating, and the distance between the socket and the bimetallic strip of the overload protection switch can result in an enormous temperature difference, in order to effectively achieve overheating to protection, an overload protection switch bimetallic strip should be installed on each of the plug sockets of the extension cord socket. However, the price of a bimetallic strip type overload protection switch is relatively high, thus installing a bimetallic strip on each of the sockets of an extension cord socket will lead to a substantial increase in cost and go against it being available to all.

SUMMARY OF THE INVENTION

Accordingly, In light of the above-described shortcomings present in currently used extension cord sockets and switches thereof, the present invention provides a heat destructive disconnecting switch comprising: a base, which is provided with a holding space; a first conductive member, which penetrates and is mounted on the base; a second conductive member, which penetrates and is mounted on the base; a movable conductive member, which is mounted within the holding space and electrically connected to the first conductive member, and selectively connects with the second conductive member; an overheating destructive member, which is destructed under a fail temperature condition, the fail temperature lying between 100° C. to 250° C.; and an operating component, which is assembled on the base, and comprises an operating member and a first elastic member. The operating member comprises a contact member and a limiting member, wherein the contact member contacts the movable conductive member, and the overheating destructive member is formed as an integral body on the limiting member. The first elastic member is compressed and confined between the contact member and the overheating destructive member, thereby providing the first elastic member with a first elastic force. The present invention further comprises a second elastic member, which is provided with a second elastic force that acts on the operating member. When the operating member is at a first position, the first elastic force presses and forces the contact member to butt against the movable conductive member, which then contacts the second conductive member to form a power-on state. When in a power-on state, an electric current passes through the first conductive member, the movable conductive member, and the second conductive member, producing heat energy that is transferred to the overheating destructive member through the contact member and the first elastic member, whereupon the overheating destructive member absorbs the heat energy and is destructed under the fail temperature condition, resulting in lessening or loss of the first elastic force. At which time the second elastic force is larger than the first elastic force, enabling the second elastic force to press and force the operating member to displace to a second position, which causes the movable conductive member to separate from the second conductive member and form a power-off state.

The above-described second elastic member is a spring.

The arrangement of the above-described first conductive member and the second conductive member is defined as being in a lengthwise direction, and the operating member is provided with a length in the lengthwise direction. The first elastic member is disposed at the central position of the length, and there is a distance between the disposed position of the second elastic member on the length and the central position.

The above-described movable conductive member is a conductive seesaw member, which astrides and is mounted on the first conductive member. The contact member slides on the conductive seesaw member, enabling the conductive seesaw member to selectively contact or separate from the second conductive member in a seesaw movement.

The above-described operating member is provided with a pivot connecting point that is pivot connected to the base, which enables the operating member to use the pivot connecting point as an axis and limit back and forth rotation, The above-described operating member further comprises a central cylinder and an inner cylinder. The limiting member and a through hole are provided in the end of the central cylinder away from the movable conductive member. The central cylinder is tightly fitted on the inner cylinder, which is provided with a penetrating retaining space. The first elastic member is inserted within the retaining space, and the two ends of the retaining space are respectively provided with a first opening and a second opening. The contact member partially penetrates into the retaining space and partially extends out the first opening. The overheating destructive member is formed as an integral body on the limiting member and positioned on the peripheral edge of the through hole, wherein the diameter of the through hole is larger than the width of the first elastic member. Moreover, restriction by the overheating destructive member that has not yet been destructed is used to compress and confine the first elastic member between the contact member and the overheating destructive member.

The above-described contact member is a hollow shaped heat conducting member, which comprises an open end and a curved contact end. The contact end contacts the movable conductive member, and one end of the first elastic member extends into the open end.

The above-described movable conductive member is a conductive cantilever member, and the second elastic member is a spring plate, wherein the first conductive member, the spring plate, and the conductive cantilever member are formed as an integral body.

The above-described base is provided with a protruding portion, and the operating member is assembled on the protruding portion. The operating member has limited up and down displacement on the protruding portion.

The above-described contact member is a supporting heat conducting member, which is provided with a limiting post and a supporting base. The limiting post extends into one end of the first elastic member, and the supporting base contacts the conductive cantilever member.

The above-described operating member further comprises a central cylinder and an inner cylinder. A limiting member and a through hole are provided in the end of the central cylinder away from the conductive cantilever member. The overheating destructive member is formed as an integral body on the limiting member and positioned on the peripheral edge of the through hole. The central cylinder is tightly fitted on the above-described inner cylinder, which is provided with a penetrating retaining space, and the first elastic member is inserted within the retaining space. The diameter of the through hole is larger than the width of the first elastic member.

The present invention also discloses a socket provided with a switch, comprising the above-described heat destructive disconnecting switch, a live wire insert piece, a live wire conductive member, a neutral wire conductive member, and a casing, wherein the casing comprises a live wire socket and a neutral wire socket, and the live wire insert piece is electrically connected to the second conductive member. The live wire insert piece comprises a live wire slot that corresponds to the live wire socket. The live wire conductive member comprises a live wire connecting end, which is electrically connected to the first conductive member, and the neutral wire conductive member comprises a neutral wire slot that corresponds to the neutral wire socket.

There are a plurality of the above-described heat destructive disconnecting switches, a plurality of the above-described live wire sockets, and a plurality of the above-described live wire insert pieces. Each of the live wire insert pieces are independently electrically connected to each of the above-described second conductive members, The live wire conductive member comprises a plurality of the live wire connecting ends, each of which is electrically connected to the respective above-described first conductive member, There are a plurality of the above-described neutral wire sockets and a plurality of the above-described neutral wire slots, wherein all of the neutral wire slots are series connected to the neutral wire conductive member.

The above-described technological characteristics provide the following advantages:

1. The overheating destructive member is not positioned in the path of the electric current, and is not responsible for transmitting current. Hence, when the present invention is used in an electric appliance or an extension cord socket, electric conductivity of the overheating destructive member is far lower than that of copper, and will not directly influence electric effectiveness of the electric appliance or the extension cord socket.

2. The entire structure is simple, easily manufactured, and will not markedly increase the size of the switch. Moreover, manufacturing cost is relatively low, and is easily embodied in known seesaw switches, press switches, or other switches.

3. Because of its small size and low cost, the heat destructive disconnecting switch is suitable for application in extension cord switches. For example, installing each of the plug sockets of the extension cord with a heat destructive disconnecting switch ensures the safety of each set of socket apertures corresponding to each of the switches when in use, and also redresses the high cost of conventional bimetallic strips, and the shortcoming thereof whereby a plurality of sets of socket apertures are required to jointly use one overload protection switch, which will not protect socket apertures distanced further away from the overload protection switch that are already overheating, resulting in an increase in temperature thereof, but the overload protection switch has still not tripped because the temperature has not yet reached the trip temperature.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

Based on the above-described technological characteristics, the major effects of a plug socket and a heat destructive disconnecting switch thereof of the present invention are clearly presented in the following embodiments.

Figure 1:
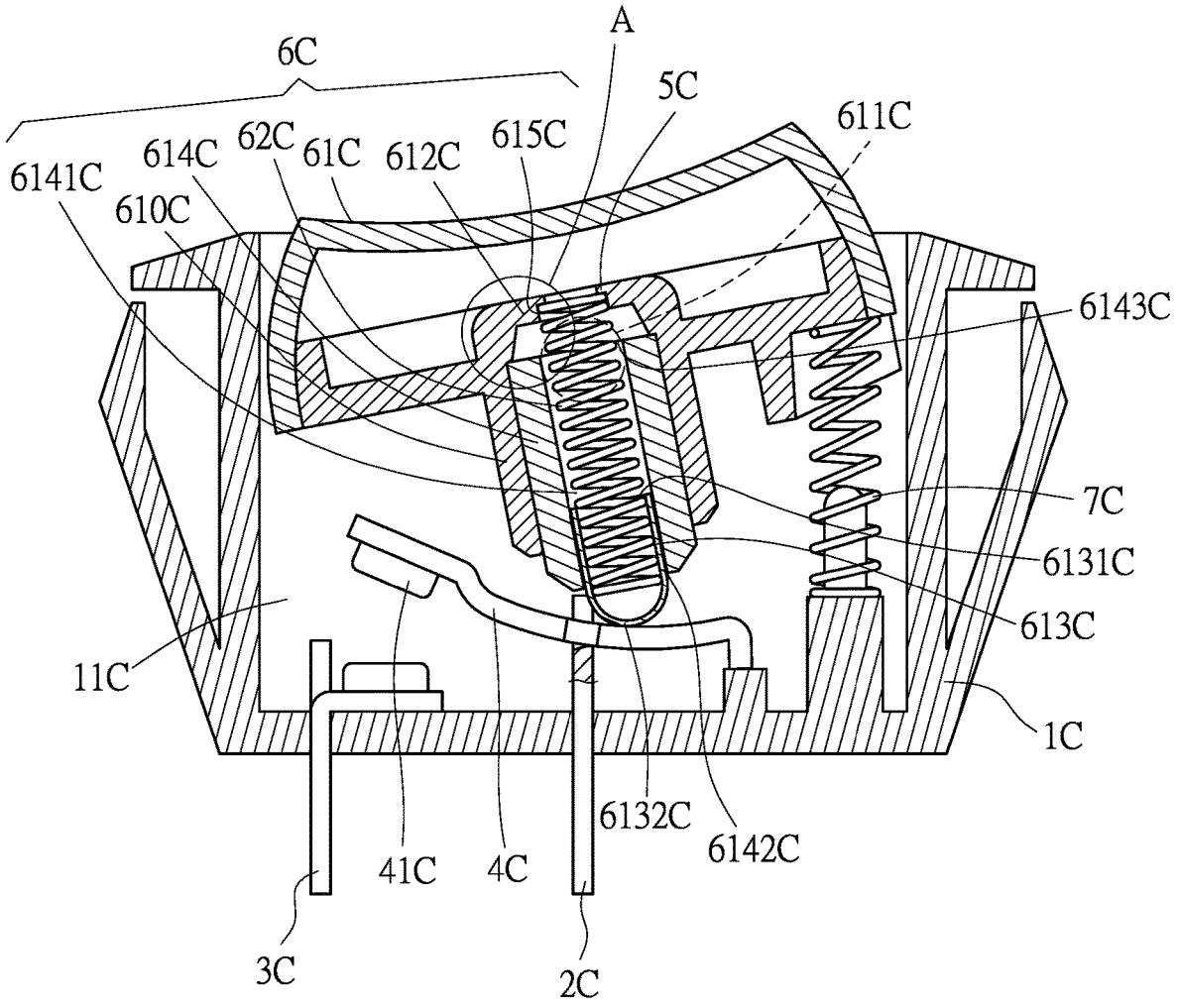
FIG. 1 is a schematic view of a first embodiment of the present invention, and shows a seesaw switch structure with the seesaw switch in a closed position.
Figure 1A:
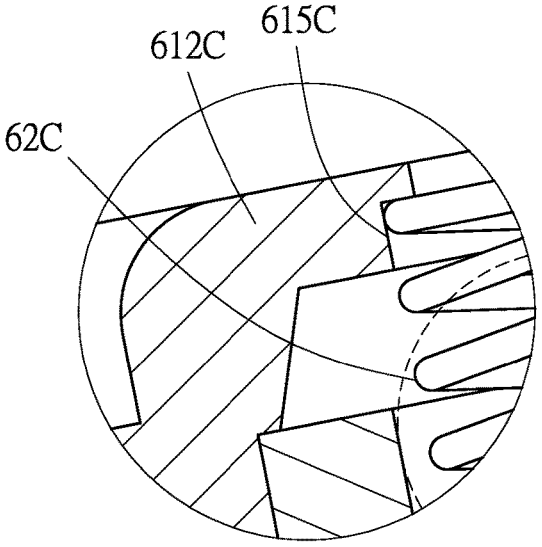
FIG. 1A is a schematic view of the first embodiment of the present invention, and shows partial enlargement of a through hole depicted in FIG. 1.

Referring to FIG. 1 and FIG. 1A, which show a first embodiment of the present invention, wherein the heat destructive disconnecting switch of the present embodiment is a seesaw switch, and FIG. 1 depicts the seesaw switch in a closed state. The seesaw switch comprises:

A base (1C), which is provided with a holding space (11C);

A first conductive member (2C) and a second conductive member (3C), both of which penetrate and are mounted on the base (1C);

A movable conductive member, which is mounted within the holding space (11C), wherein the movable conductive member is a conductive seesaw member (4C) that astrides and is mounted on the first conductive member (2C) and electrically connected thereto; and An overheating destructive member (5C) that is destructed under a fail temperature condition, the fail temperature lying between 100° C. to 250° C. The overheating destructive member (5C) is not used to maintain the continued supply of electric current; therefore, insulating material such as plastic can be used or non-insulating material made from a low-melting alloy, such as an alloy of bismuth and any one of or a composition from a plurality of the metals cadmium, indium, silver, tin, lead, antimony, or copper; or other low-melting metals or alloys with melting points lying between 100° C. to 250° C., such as a tin-bismuth alloy with a melting point around 138° C.

When there is a temperature anomaly in the operating temperature, resulting in a rise in temperature, it is preferred that a live wire triggers a circuit break. Therefore, the first conductive member (2C) in use is a live wire first end, the second conductive member (3C) in use is a live wire second end, and the conductive seesaw member (4C) is used to enable electrical conduction with the first conductive member (2C) and the second conductive member (3C) to form a live wire closed circuit.

The seesaw switch of the present embodiment is further provided with an operating component (6C), which is used to operate the conductive seesaw member (4C) to connect with the first conductive member (2C) and the second conductive member (3C) to form a live wire closed circuit, or disconnect the circuit between the first conductive member (2C) and the second conductive member (3C), causing the live wire to form an open circuit. The operating component (6C) is assembled on the base (1C) and comprises an operating member (61C) and a first elastic member (62C), wherein the operating member (61C) provides a press surface as a nonconductor. The operating member (61C) is also provided with a pivot connecting point (611C), which is pivot connected to the base (1C) to enable the operating member (61C) to use the pivot connecting point (611C) as an axis and limit back and forth rotation. The operating member (61C) further comprises a contact member, a central cylinder (610C), an inner cylinder (614C), and a limiting member (612C). The contact member is a hollow shaped heat conducting member (613C), which comprises an open end (6131C) and a curved contact end (6132C). The contact end (6132C) of the heat conducting member (613C) contacts the conductive seesaw member (4C). The limiting member (612C) and a through hole (615C) are provided in the end of the central cylinder (610C) away from the conductive seesaw member (4C), and the central cylinder (610C) is tightly fitted on the above-described inner cylinder (614C). The inner cylinder (614C) is provided to with a penetrating retaining space (6141C), and the first elastic member (62C) is inserted within the retaining space (6141C). The two ends of the retaining space (6141C) are respectively provided with a first opening (6142C) and a second opening (6143C). The heat conducting member (613C) partially penetrates into the retaining space (6141C) and partially extends out from the first opening (6142C). The overheating destructive member (5C) is formed as an integral body on the limiting member (612C) and positioned on the peripheral edge of the through hole (615C). The diameter of the through hole (615C) is larger than the width of the first elastic member (62C), and one end of the first elastic member (62C) extends into the open end (6131C) of the heat conducting member (613C). Moreover, restriction by the overheating destructive member (5C) that has not yet been destructed is used to compress and confine the first elastic member (62C) between the heat conducting member (613C) and the overheating destructive member (5C), thereby providing the first elastic member (62C) with a first elastic force.

The seesaw switch of the present embodiment is further provided with a second elastic member (7C), which, in the present embodiment, is a spring. The second elastic member (7C) is provided with a second elastic force that acts on the operating member (61C).

Figure 2:
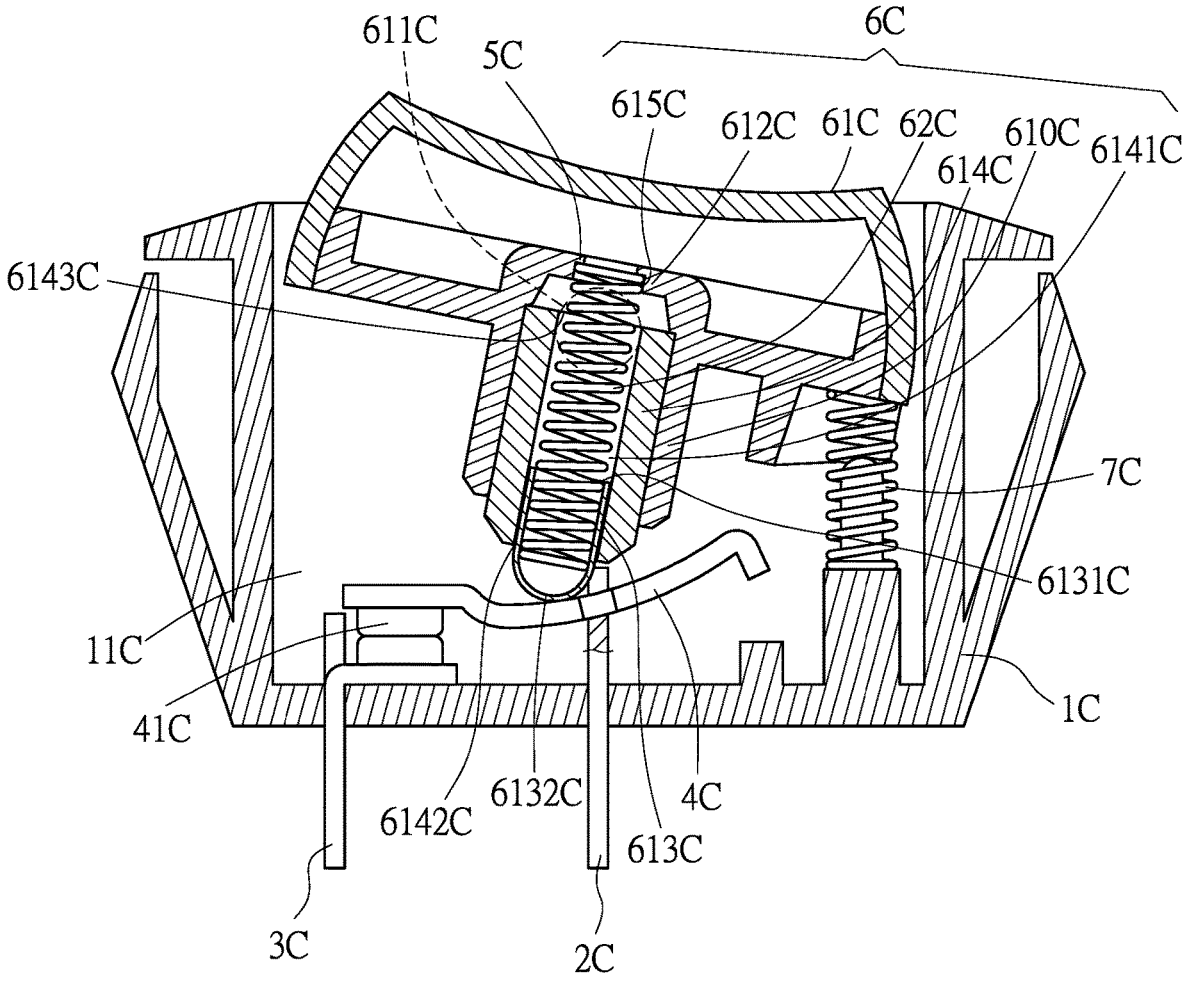
FIG. 2 is a schematic view of the first embodiment of the present invention, and shows the seesaw switch in an open position.

Referring to FIG. 2, a user toggles the operating member (61C) back and forth around the pivot connecting point (611C), which causes the heat conducting member (613C) to slide on the conductive seesaw member (4C), thereby enabling selective contact or separation of the heat conducting member (613C) from the second conductive member (3C) in a seesaw movement. When the heat conducting member (613C) slid on the conductive seesaw member (4C) in the direction of a silver contact point (41C) on the conductive seesaw member (4C), the first elastic force forces the silver contact point (41C) to contact the second conductive member (3C) and form a power-on state.

Figure 3:
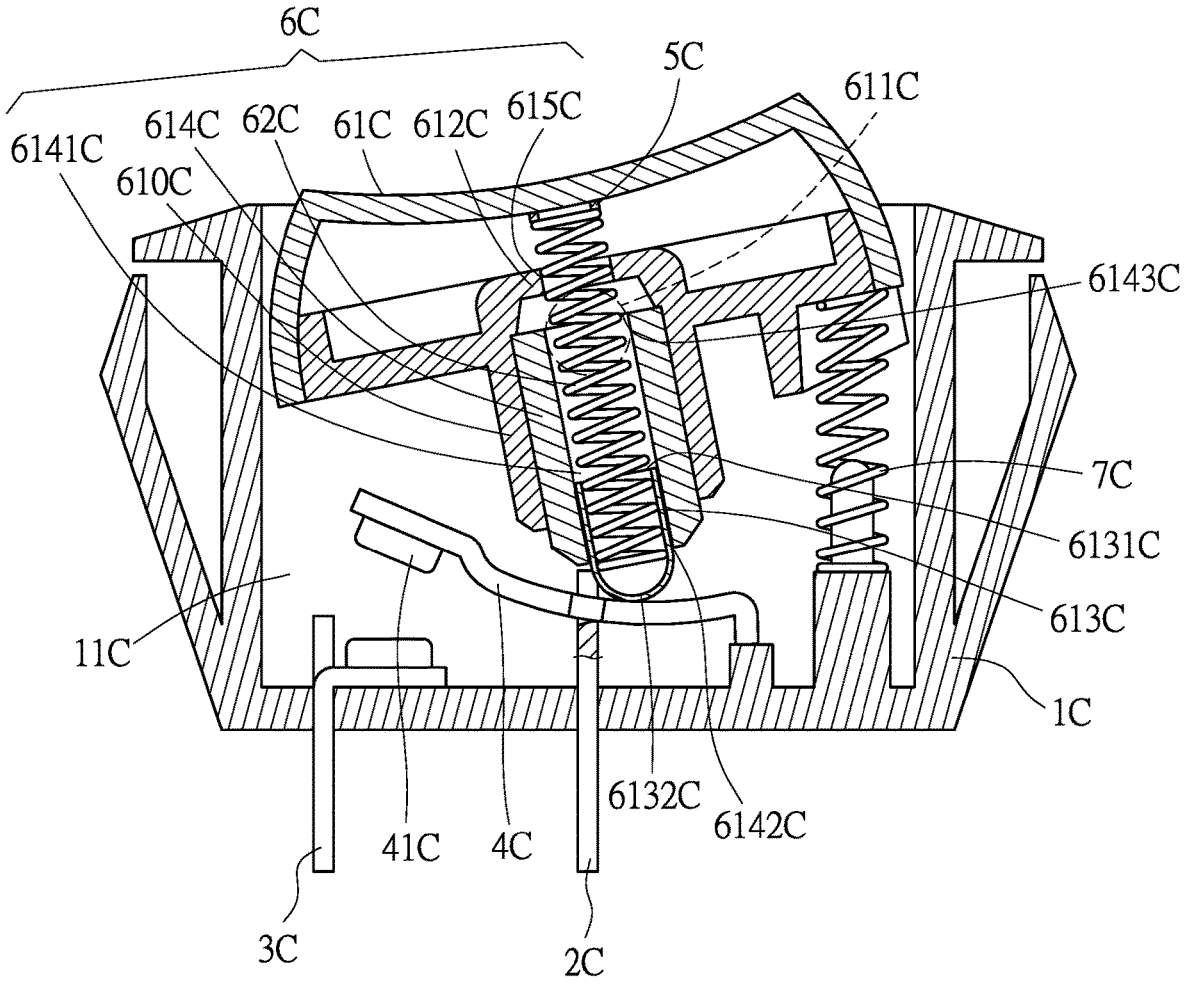
FIG. 3 is a schematic view of the first embodiment of the present invention, and shows, when an overheating destructive member is destructed due to overheating, a movable conductive member separated from a second conductive member, causing the seesaw switch to revert to a closed position from an open position and form an open circuit.

Referring to FIG. 3, when an abnormal condition occurs in an external electric equipment connected to the first conductive member (2C) or the second conductive member (3C), for example, the external electric equipment is a plug socket, oxides or dust present between the metal pins of a plug and the plug socket, or phenomena such as incomplete insertion of the metal pins or distorted metal pins will produce relatively large amounts of heat energy in the electrical conducting portions of the plug socket, whereupon the heat energy is transferred to the conductive seesaw member (4C) through the first conductive member (2C) or the second conductive member (3C), and then through the heat conducting member (613C) and the first elastic member (62C) to the overheating destructive member (5C). The overheating destructive member (5C) gradually absorbs the heat energy up to the melting point thereof, at which time the overheating destructive member (5C) begins to gradually lose its rigidity. For example, if the material of the overheating destructive member (5C) is a tin-bismuth alloy, although the melting point thereof is 138° C., the tin-bismuth alloy begins to lose its rigidity when the temperature is close to its melting point, and under the concurrent effect of the first elastic force, the overheating destructive member (5C) is compressed and deformed by the first elastic member (62C) to the extent of being destructed. This causes the first elastic member (62C) to break through the overheating destructive member (5C) and extend out through the through hole (615C), resulting in lessening or loss of the first elastic force; at which time the second elastic force is larger than the first elastic force. In the present embodiment, the arrangement of the first conductive member (2C) and the second conductive member (3C) is defined as being in a lengthwise direction, and the operating member (61C) has a length in the lengthwise direction. The first elastic member (62C) is disposed at the central position of the length. There is a distance between the disposed position of the second elastic member (7C) on the length and the central position; therefore, when the second elastic force is larger than the first elastic force, a torque effect forces the operating member (61C) to rotate on the pivot connecting point (611C) as an axis and slides the heat conducting member (613C) on the conductive seesaw member (4C), thereby forcing the operating member (61C) to displace and form a closed position. Accordingly, the silver contact point (41C) of the conductive seesaw member (4C) separates from the second conductive member (3C) to form a power-off state, thereby achieving the protective effect against overheating.

Figure 4:
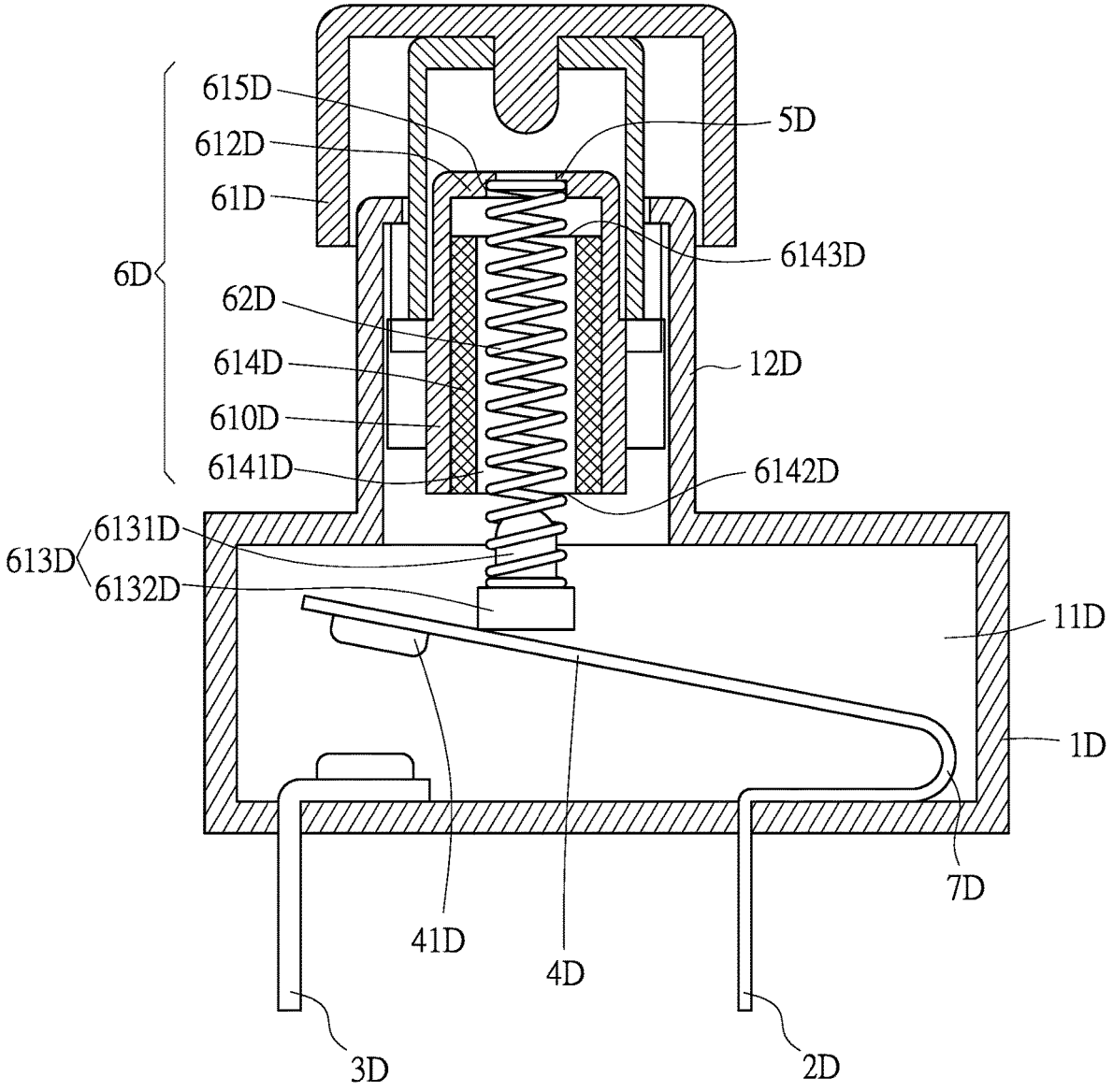
FIG. 4 is a schematic view of a second embodiment of the present invention, and shows a press switch structure with the press switch in a closed position.

Referring to FIG. 4, which shows a second embodiment of the present invention, wherein the heat destructive disconnecting switch of the present embodiment is a press switch. FIG. 4 shows the press switch in a closed state, comprising:

A base (1D), which is provided with a holding space (11D) and a protruding portion (12D);

A first conductive member (2D) and a second conductive member (3D), both of which penetrate and are mounted on the base (1D);

A movable conductive member, which is mounted within the holding space (11D), wherein the movable conductive member is a conductive cantilever member (4D); and An overheating destructive member (5D), which is destructed under a fail temperature condition, the fail temperature lying between 100° C. to 250° C. The overheating destructive member (5D) is not used to maintain the continued supply of electric current, therefore, insulating material such as plastic can be used or non-insulating material made from a low-melting alloy, such as an alloy of bismuth and any one of or a composition from a plurality of the metals cadmium, indium, silver, tin, lead, antimony, or copper; or other low-melting metals or alloys with melting points lying between 100° C. to 250° C., such as a tin-bismuth alloy with a melting point around 138° C.

When there is a temperature anomaly in the operating temperature, resulting in a rise in temperature, it is preferred that a live wire triggers a circuit break. Therefore, the first conductive member (2D) in use is a live wire first end, the second conductive member (3D) in use is a live wire second end, and the conductive cantilever member (4D) is used to conduct current to the first conductive member (2D) and the second conductive member (3D) to form a live wire closed circuit.

The press switch of the present embodiment is further provided with an operating component (6D), which is used to operate the conductive cantilever member (4D) to connect with the first conductive member (2D) and the second conductive member (3D) to form a live wire closed circuit, or disconnect the circuit between the first conductive member (2D) and the second conductive member (3D), causing the live wire to form an open circuit. The operating component (6D) is assembled on the base (1D) and comprises an operating member (61D) and a first elastic member (62D), wherein the operating member provides a press surface as a nonconductor. The operating member (61D) is mounted on the protruding portion (12D) and has limited up and down displacement thereon. The up and down displacement and positioning structure of the entire operating component (6D) is the same as the press button structure of an automatic ball-point pen of the prior art, such as the prior art structure of a "Push-button Switch" disclosed in China Patent No. CN103441019; therefore, the drawings of the present embodiment omit illustrating a number of structural positions disclosed in the prior art. The operating member (61D) comprises a contact member, a central cylinder (610D), an inner cylinder (614D), and a limiting member (612D). The limiting member (612D) and a through hole (615D) are provided in the end of the central cylinder (610D) away from the conductive cantilever member (4D). The central cylinder (610D) is tightly fitted on the above-described inner cylinder (614D), and the inner cylinder (614D) is provided with a penetrating retaining space (6141D). The first elastic member (62D) is inserted within the retaining space (6141D), and the two ends of the retaining space (6141D) are respectively provided with a first opening (6142D) and a second opening (6143D). The contact member is a supporting heat conducting member (613D) that is installed at the first opening (6142D). The overheating destructive member (5D) is formed as an integral body on the limiting member (612D), and is positioned on the peripheral edge of the through hole (615D). The diameter of the through hole (615D) is larger than the width of the first elastic member (62D). The supporting heat conducting member (613D) is provided with a limiting post (6131D) and a supporting base (6132D), wherein the limiting post (6131D) extends into one end of the first elastic member (62D), causing the first elastic member (62D) to butt against the supporting base (6132D), and thereby enabling the supporting base (6132D) to contact the conductive cantilever member (4D). Restriction by the overheating destructive member (5D) that has not yet been destructed is used to compress and confine the first elastic member (62D) between the supporting heat conducting member (613D) and the overheating destructive member (5D), thereby providing the first elastic member (62D) with a first elastic force.

The press switch of the present embodiment is further provided with a second elastic member, which is a spring plate (7D). The first conductive member (2D), the spring plate (7D), and the conductive cantilever member (4D) are formed as an integral body. The spring plate (7D) is provided with a second elastic force that acts on the operating member (61D).

Figure 5:
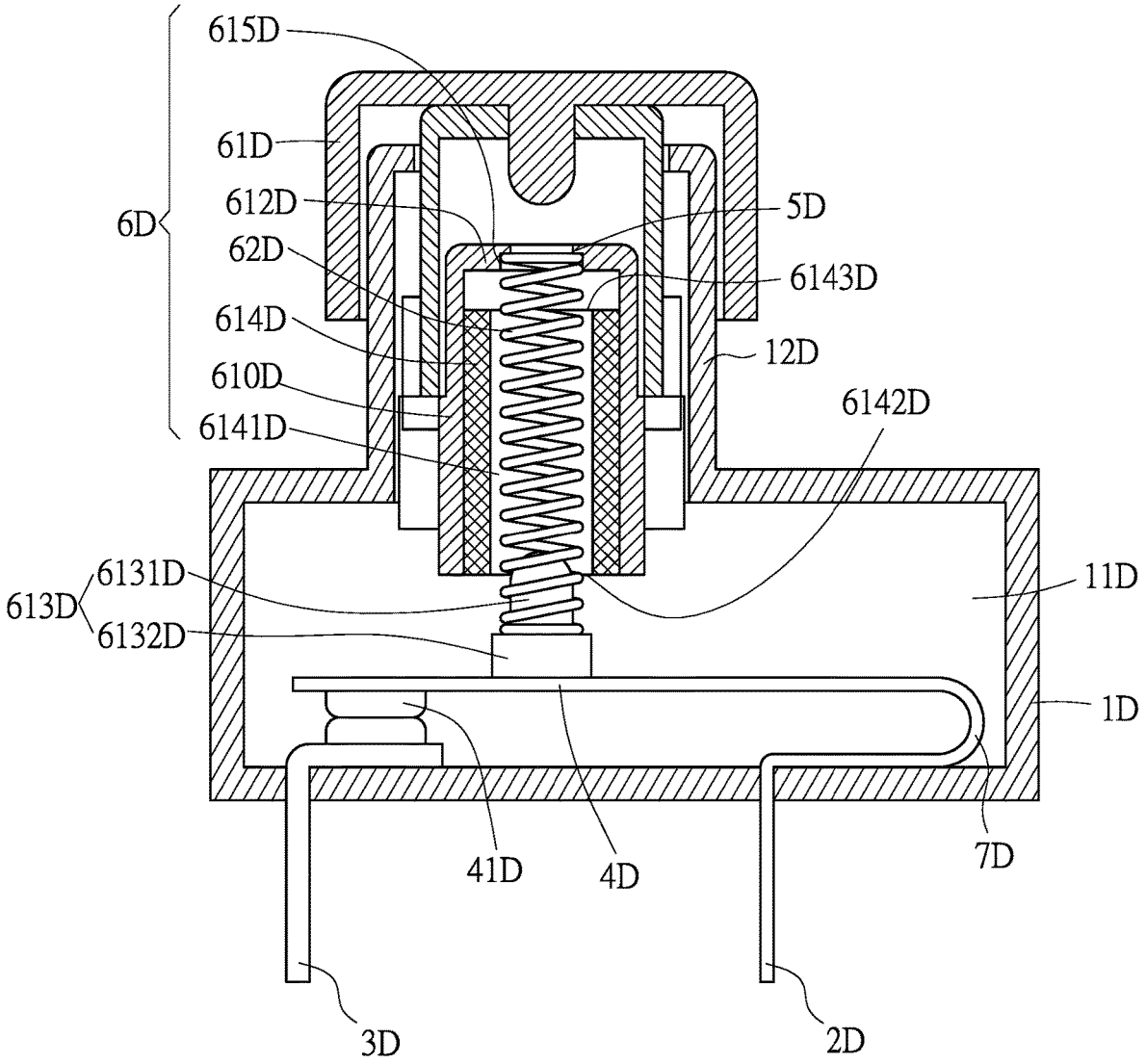
FIG. 5 is a schematic view of the second embodiment of the present invention, and shows the press switch in an open position.

Referring to FIG. 5, a user displaces the operating member (61D) relative to the protruding portion (12D), just like pressing the button on an automatic ball-point pen, which causes the conductive cantilever member (4D) to selectively contact or separate from the second conductive member (3D). When the operating member (61D) is displaced in the direction of the conductive cantilever member (4D) and positioned, the supporting base (6132D) of the supporting heat conducting member (613D) presses a position close to a silver contact point (41D) of the conductive cantilever member (4D), which causes the conductive cantilever member (4D) to contact the second conductive member (3D) and form a power-on state. At the same time, the first elastic member (62D) is further compressed, enlarging the first elastic force thereof, at which time the first elastic force is larger than the second elastic force.

Figure 6:
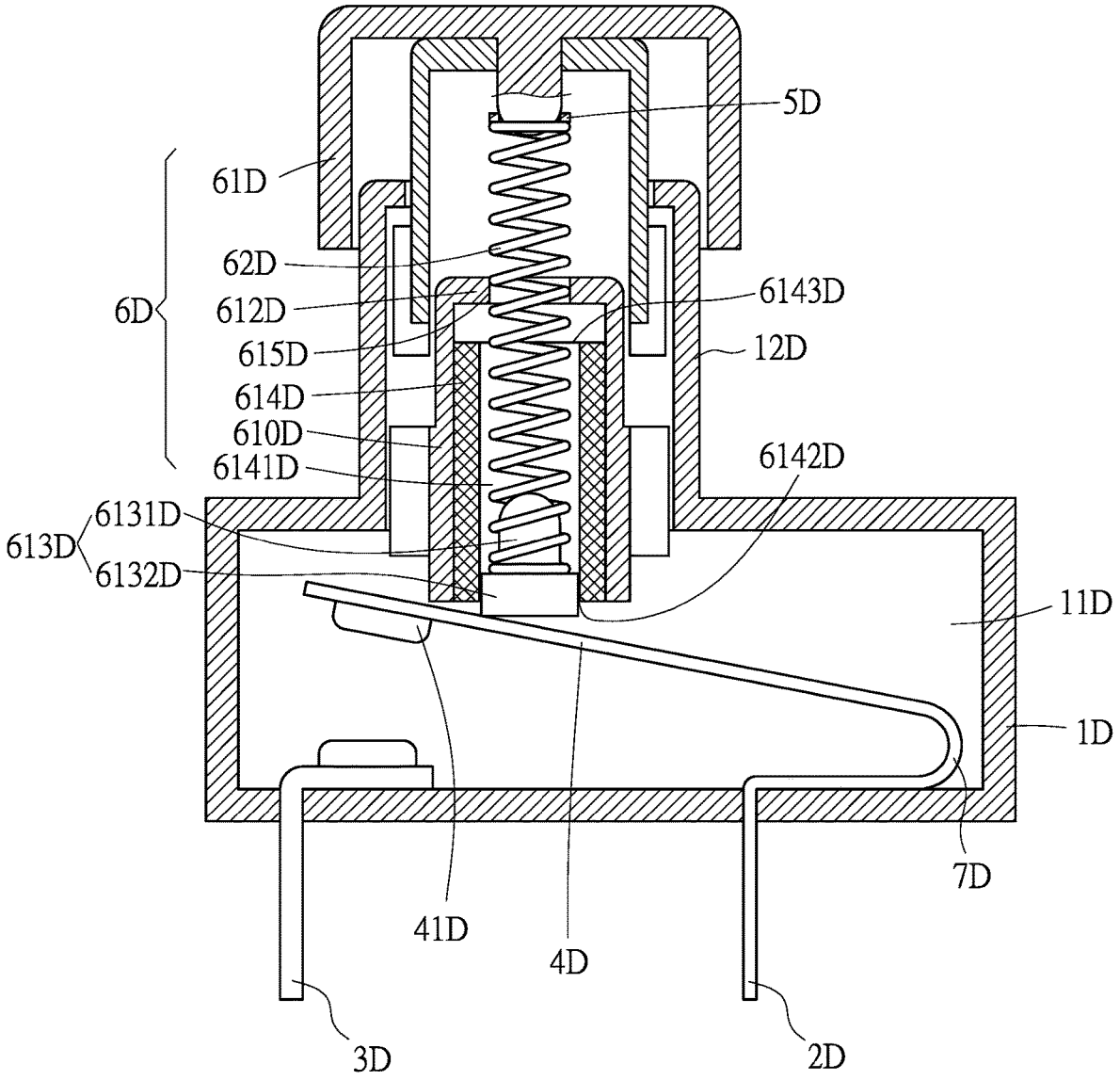
FIG. 6 is a schematic view of the second embodiment of the present invention, and shows, when an overheating destructive member is destructed due to overheating, a movable conductive member separated from a second conductive member to form an open circuit.

Referring to FIG. 6, when an abnormal condition occurs in an external electric equipment connected to the first conductive member (2D) or the second conductive member (3D), for example, the external electric equipment is a plug socket, oxides or dust present between the metal pins of a plug and the plug socket, or incomplete insertion or distortion of the metal pins will produce relatively large amounts of heat energy in the electrical conducting portions of the plug socket, whereupon, the heat energy is transferred to the conductive cantilever member (4D) through the first conductive member (2D) or the second conductive member (3D), and then through the supporting base (6132D) of the supporting heat conducting member (613D), the limiting post (6131D), and the first elastic member (62D) to the overheating destructive member (5D). The heat is then finally transferred to the overheating destructive member (5D), which gradually absorbs the heat energy up to the melting point thereof, at which time the overheating destructive member (5D) begins to gradually lose its rigidity. For example, if the material of the overheating destructive member (5D) is a tin-bismuth alloy, although the melting point thereof is 138° C., the tin-bismuth alloy begins to lose its rigidity when the temperature is close to its melting point, and under the concurrent effect of the first elastic force, the overheating destructive member (5D) is compressed and deformed by the first elastic member (62D) to the extent of being destructed, and, thus, no longer able to restrain the first elastic member (62D). Consequently, the first elastic member (62D) destructs the overheating destructive member (5D) and extends out through the through hole (615D), resulting in lessening or loss of the first elastic force, at which time the second elastic force is larger than the first elastic force, which forces the conductive cantilever member (4D) to restore its original position, causing the silver contact point (41D) of the conductive cantilever member (4D) to separate from the second conductive member (3D) and form a power-off state, thereby achieving the protective effect against overheating.

Figure 7:
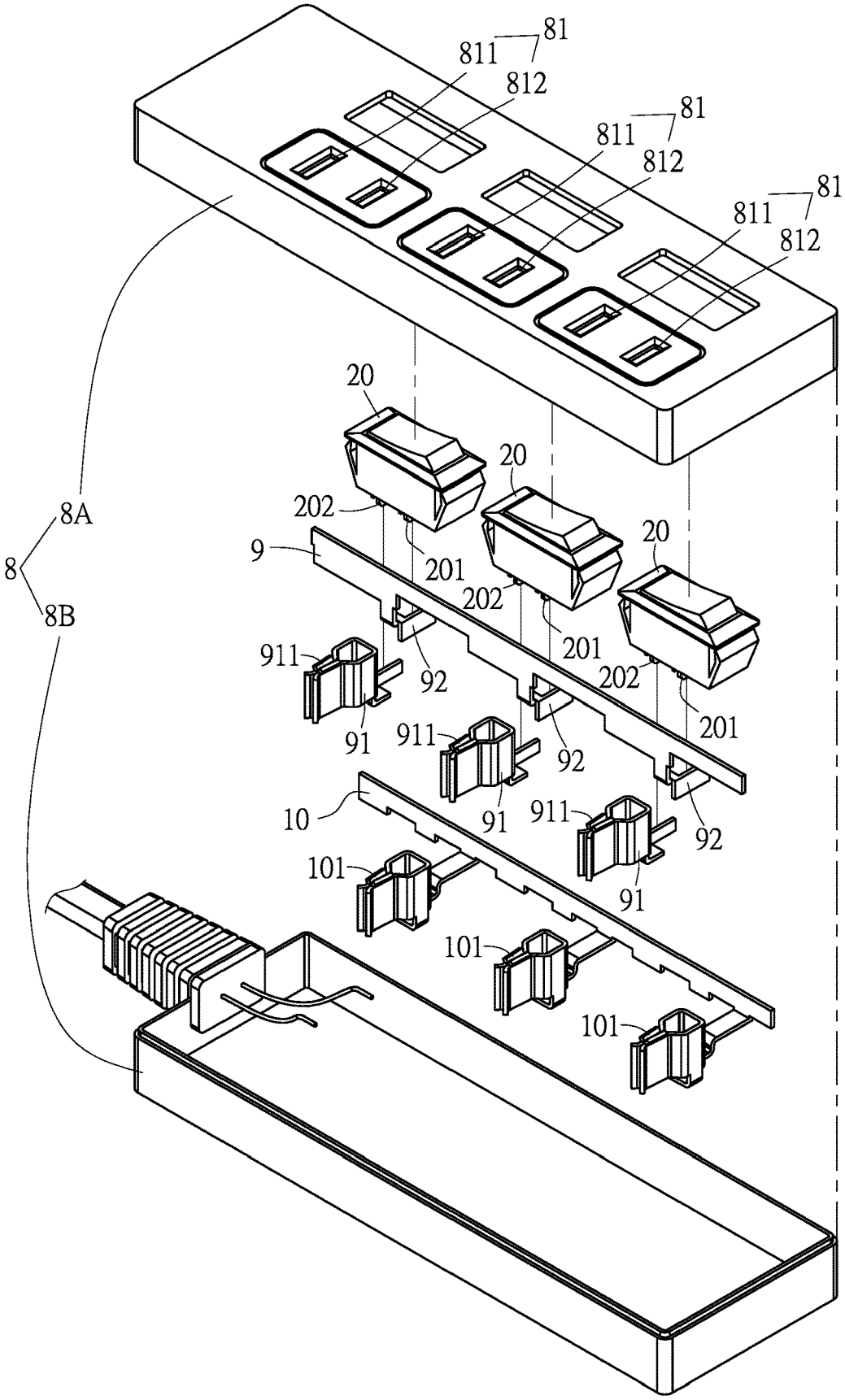
FIG. 7 is an exploded view of a third embodiment of the heat destructive disconnecting switch of the present invention used in an extension cord socket.
Figure 8:
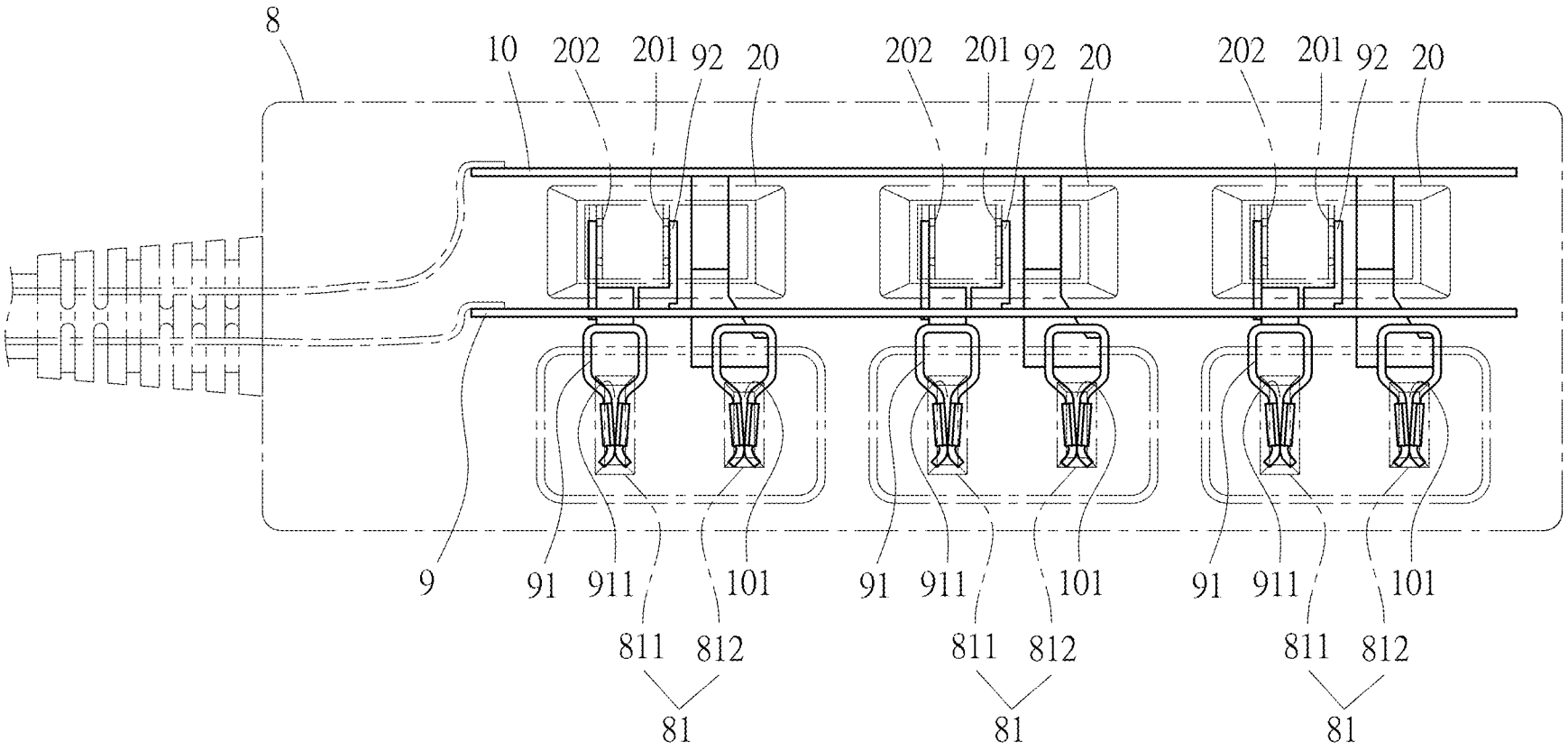
FIG. 8 is a structural view of the third embodiment of the heat destructive disconnecting switch of the present invention used in an extension cord socket.

Referring to FIG. 7 and FIG. 8, which show a third embodiment of the present invention, wherein the heat destructive disconnecting seesaw switch of the above-described embodiment is applied in an extension cord socket comprising three socket aperture (81). The extension cord socket comprises:

A casing (8), which is provided with an upper casing (8A) and a lower casing (8B), wherein the upper casing (8A) comprises the three socket apertures (81), and each of the socket apertures (81) comprises a live wire socket (811) and a neutral wire socket (812);

A live wire conductive member (9), which is installed in the casing (8), wherein the live wire conductive member (9) is provided with three spaced live wire connecting ends (92) corresponding to three independent live wire insert pieces (91), each of which comprises a live wire slot (911). The live wire slots (911) correspond to the live wire sockets (811);

A neutral wire conductive member (1C), which is installed in the casing (8), wherein the neutral wire conductive member (1C) is provided with three spaced neutral wire slots (101). The neutral wire slots (101) respectively correspond to the neutral wire sockets (812); and Three heat destructive disconnecting switches (20), which are as described above in the first embodiment and the second embodiment, wherein a first conductive member (201) of each of the heat destructive disconnecting switches (20) is connected to the respective live wire connecting end (92) of the live wire conductive member (9) or the live wire insert piece (91), and a second conductive member (202) is connected to the respective live wire insert piece (91) or the live wire connecting end (92) of the live wire conductive member (9). The present embodiment uses the first conductive members (201) respectively connected to the live wire insert pieces (91) and the second conductive members (202) respectively connected to the live wire connecting ends (92) of the live wire conductive member (9) as an example (the characteristics of the connecting method for this portion is described above in the first embodiment and the second embodiment, and thus not further detailed herein). Accordingly, when there is a temperature anomaly in the operating temperature resulting in a rise in temperature in any one of the live wire insert pieces (91) of the extension cord socket, heat energy is transferred to the heat destructive disconnecting switch (20) associated therewith through the first conductive member (201) or the second conductive member (202), whereupon overheating causes the heat destructive disconnecting switch (20) to break the circuit and cut off the supply of power. At which time the live wire insert piece (91) with an abnormal temperature immediately cuts off the supply of power, stopping the operating temperature from continuing to rise and enabling the operating temperature to slowly fall. Because each of the heat destructive disconnecting switches (20) independently controls a set of the live wire socket (811) and neutral wire socket (812), when any one of the heat destructive disconnecting switches (20) breaks the circuit due to overheating, the other sets of the live wire socket (811) and neutral wire socket (812) can still continue to operate as normal.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A heat destructive disconnecting switch, comprising:

a base, which is provided with a holding space;

a first conductive member, which penetrates and is mounted on the base;

a second conductive member, which penetrates and is mounted on the base;

a movable conductive member, which is mounted within the holding space and electrically connected to the first conductive member, and selectively connects with the second conductive member;

an overheating destructive member, which is destructed under a fail temperature condition, the fail temperature lying between 100° C. to 250° C.;

an operating component, which is assembled on the base, wherein the operating component comprises an operating member and a first elastic member, the operating member comprises a contact member and a limiting member, the contact member contacts the movable conductive member; the overheating destructive member is formed as an integral body on the limiting member, the first elastic member is compressed and confined between the contact member and the overheating destructive member and is provided with a first elastic force;

a second elastic member, which is provided with a second elastic force that acts on the operating member;

wherein arrangement of the first conductive member and the second conductive member is defined as being in a lengthwise direction; the operating member is provided with a length in the lengthwise direction, the first elastic member is disposed at a central position of the length of the operating member, and there is a distance between a disposed position of the second elastic member on the length of the operating member and the central position;

whereby when the operating member is at a first position, the first elastic force presses and forces the contact member to butt against the movable conductive member, which then contacts the second conductive member to form a power-on state; when in the power-on state, an electric current passes through the first conductive member, the movable conductive member, and the second conductive member and produces heat energy, which is transferred to the overheating destructive member through the contact member and the first elastic member, the overheating destructive member absorbs the heat energy and is destructed under the fail temperature condition, resulting in lessening or loss of the first elastic force, at which time the second elastic force is larger than the first elastic force, and the second elastic force presses and forces the operating member to displace to a second position, thereby causing the movable conductive member to separate from the second conductive member and form a power-off state.

2. The heat destructive disconnecting switch according to claim 1, wherein the second elastic member is a spring.

3. The heat destructive disconnecting switch according to claim 1, wherein the movable conductive member is a conductive seesaw member, which astrides and is mounted on the first conductive member; the contact member slides on the conductive seesaw member, thereby enabling the conductive seesaw member to selectively contact or separate from the second conductive member in a seesaw movement.

4. The heat destructive disconnecting switch according to claim 1, wherein the operating member is provided with a pivot connecting point that is pivotably connected to the base, thereby enabling the operating member to use the pivot connecting point as an axis and limit back and forth rotation.

5. The heat destructive disconnecting switch according to claim 1, wherein the operating member further comprises a central cylinder and an inner cylinder, the limiting member and a through hole are provided in an end of the central cylinder away from the movable conductive member, and the central cylinder is tightly fitted on the inner cylinder; the inner cylinder is provided with a penetrating retaining space, and the first elastic member is inserted within the penetrating retaining space, two ends of the penetrating retaining space are respectively provided with a first opening and a second opening, the contact member partially penetrates into the penetrating retaining space and also partially extends out the first opening, the overheating destructive member is formed as an integral body on the limiting member and positioned on peripheral edge of the through hole, a diameter of the through hole is larger than a width of the first elastic member, and restriction by the overheating destructive member that has not yet been destructed is used to compress and confine the first elastic member between the contact member and the overheating destructive member.

6. The heat destructive disconnecting switch according to claim 1, wherein the contact member is a hollow shaped heat conducting member, which comprises an open end and a curved contact end; the contact end contacts the movable conductive member, and one end of the first elastic member extends into the open end.

* * * * *